US007316521B2

(12) United States Patent
Shiomoto et al.

(10) Patent No.: US 7,316,521 B2
(45) Date of Patent: Jan. 8, 2008

(54) WATERPROOF SHEET IN-SITU APPLICATION MACHINE

(75) Inventors: Chiezo Shiomoto, Hiroshima (JP); Takahiro Shiomoto, Hiroshima (JP)

(73) Assignee: AOI Techno Service Kabushiki Kaisha, Hiroshima (JP)

( * ) Notice: Subject to any disclaimer, the term of this patent is extended or adjusted under 35 U.S.C. 154(b) by 243 days.

(21) Appl. No.: 11/094,422

(22) Filed: Mar. 31, 2005

(65) Prior Publication Data

US 2006/0024133 A1 Feb. 2, 2006

(30) Foreign Application Priority Data

Jul. 30, 2004 (JP) ..... 2004-224514

(51) Int. Cl.
*E01C 21/00* (2006.01)
*E01C 19/46* (2006.01)
*B29C 65/02* (2006.01)

(52) U.S. Cl. ..... 404/100; 404/83; 404/101; 404/103; 156/577; 156/497

(58) Field of Classification Search ..... 404/31, 404/83, 100, 101
See application file for complete search history.

(56) References Cited

U.S. PATENT DOCUMENTS 3,822,956 A * 7/1974 Wirtgen ..... 404/95
3,886,011 A * 5/1975 Eigenmann ..... 156/71
4,259,142 A * 3/1981 Kortepeter ..... 156/497
4,354,893 A * 10/1982 Kugler et al. ..... 156/497
4,376,007 A * 3/1983 Eigenmann ..... 156/497
4,456,399 A * 6/1984 Conover ..... 404/100
4,533,423 A * 8/1985 Johnson et al. ..... 156/359
4,684,289 A * 8/1987 Gnesa ..... 404/75
4,699,330 A * 10/1987 Barazone ..... 242/557
4,705,229 A * 11/1987 Barazone ..... 242/557
4,708,518 A * 11/1987 Eigenmann ..... 404/79
4,742,970 A * 5/1988 Barazone ..... 242/557
4,793,731 A * 12/1988 Gnesa ..... 404/83
4,806,194 A * 2/1989 Wald ..... 156/379.8
4,869,044 A * 9/1989 Wald ..... 52/746.11
H000982 H * 11/1991 Berggren et al. ..... 156/275.1
5,439,540 A * 8/1995 Lippman et al. ..... 156/71
5,624,511 A * 4/1997 Lippman ..... 156/64
6,789,446 B2 * 9/2004 Ishikawa ..... 74/730.1

FOREIGN PATENT DOCUMENTS

JP A 08-092905 4/1996
JP A 2001-207414 8/2001

* cited by examiner

*Primary Examiner*—Raymond W Addie
(74) *Attorney, Agent, or Firm*—Oliff & Berridge, PLC

(57) ABSTRACT

A waterproof sheet in-situ application machine, which can rewind a long roll-like thermal application type waterproof sheet and easily bond the sheet onto the bed surface of a bridge and the surface of a concrete structure in a site, includes a carriage and a combination of any one or two or more of a water permeable stand, a wrinkle prevention drum, a sheet heater, a sheet overlapping portion heater, a sheet roller pressing steel wheel roller, and a sheet roller pressing rubber tire mounted on the carriage. The sheet heater is composed of a heat resistant metal roller having a far infrared ray heater, an electric heater, etc. inserted therein, and the surface of the waterproof sheet is molten by being caused to be contact with the surface of the metal roller, thereby the waterproof sheet can be bonded onto an execution surface.

18 Claims, 4 Drawing Sheets

WATERPROOF SHEET IN-SITU APPLICATION MACHINE

BACKGROUND OF THE INVENTION

1. Field of the Invention

The present invention relates to a construction method of forming a waterproof layer on a bed surface of a concrete bridge (RC, PC, steel bridge) on which an asphalt pavement is formed, a large concrete surface of a rooftop parking and the like on which an asphalt pavement is formed, and a concrete base layer of a water permeable asphalt concrete pavement, and the present invention provides a waterproof sheet in-situ application machine capable of effectively laying a concrete surface with a waterproof sheet in a short time and executing a construction work easily and securely while suppressing occurrence of problems of blistering, wrinkles, and the like.

2. Description of the Related Art

In civil engineering and construction works, a waterproofing work executed to a concrete surface is a very important work which decides the destiny of the civil engineering and construction works. That is, if a waterproofing work is executed imperfectly to a civil engineering structure or a building structure, not only the durable periods the structures are greatly shortened but also all the assets installed in the structures may be lost.

An example of waterproofing mainly in a civil engineering work will be explained below with reference to a concrete bridge (including a concrete structure such as a rooftop parking and the like) and a concrete pavement.

In the concrete bridge, an asphalt pavement is formed on a concrete bed. When, however, rain water passing through the asphalt pavement reaches reinforcing steel rods inside concrete from the surface of the concrete bed, cracks formed in the concrete, and the like, the rain water corrodes the reinforcing steel rods and adversely affects the life of the concrete bridge itself. To cope with this problem, a waterproof layer is formed on the surface of the concrete bed before the asphalt pavement is formed.

A coating type waterproof material, a sheet type waterproof material, and the like are conventionally used as the waterproof layer. In the coating type waterproof material, rubber asphalt melted at a high temperature is flowingly coated onto a bed surface uniformly and cooled by being left as it is to thereby form a rubber asphalt layer, or a coating material, which is made by cutting back synthetic rubber such as chloroprene rubber and the like, is coated onto a bed surface and a solvent is vaporized from the rubber to thereby form a uniform rubber film.

In these coating type waterproof materials, the thickness of a layer which is able to be formed by coating the material at one time is thin, and further it is predicted that the materials are coated unevenly. Thus, to provide the waterproof materials with a sufficient function as a waterproof layer, a plurality of layers must be formed by coating the materials several times with a drying time set each time they are coated in place of coating them only once, which cannot help requiring a complicated job in execution of the work.

In a construction method using the sheet type waterproof material, a waterproof layer is formed by applying a waterproof sheet, which is made by combining rubber-like asphalt and the like with a fiber material such as non-woven fabric and the like, onto the overall surface of a concrete bed using a application agent composed of heated and molten asphalt and the like. In this case, however, since the waterproof sheet is bonded onto the bed surface using the asphalt molten at a high temperature, a dangerous job is required as well as the surrounding of an execution site is adversely affected by offensive odors and the like, and thus the construction method using the sheet type waterproof material is not preferable. Further, the execution of the method is complex and time consuming and requires skill.

In an asphalt pavement having a drainage property (water permeable property) outstandingly constructed recently, since the pavement is formed of a mixture of aggregates, which has a grain size adjusted so that they have fine intervals through which water can pass, and modified asphalt, the pavement has the water permeable property by itself. With this structure, the asphalt pavement contributes to reduce water staying thereon when rain falls, to improve a vehicle traveling performance, and to prevent a hydroplaning phenomenon at the beginning of rainfall. However, since the water permeable pavement does not have sufficient durability by itself, such a structure is employed that a concrete pavement having high durability is formed as a base, and the water permeable pavement is overlaid thereon. This structure intends to guarantee the durability of a road by the bed composed of the concrete pavement and to replace the water permeable overlay layer when the end of life thereof is reached. Conventionally, a tack coat, which is called a "seal layer", that is, an asphalt emulsion used to enhance the application property of concrete with asphalt, or cut back asphalt is simply applied to the surface of the concrete pavement before a water permeable asphalt pavement is laid on the surface thereof. However, the base composed of the concrete pavement cannot be observed from the surface thereof due to the asphalt layer formed on the upper surface thereof regardless that it guarantees the durability of the road. Therefore, even if defective portions such as cracks are made on the surface of the base, they cannot be detected. In such circumferences, since rain water flows onto the surface of the concrete base at all times through the water permeable pavement, rain water penetrates to the base composed of the concrete pavement from defective portions and corrodes reinforcing steel rods in the base, from which there is a possibility that the life of the road is shortened. This is a reason why prime importance is placed on the waterproofing of the base composed of the concrete pavement.

Ordinarily, however, since a road does not have a limited area but has a long distance and a large area, when a waterproof layer is formed on the road by the construction method employed in a road bridge as described above, serious problems arise in the extension of a construction period, an increase in construction cost, shortage of skilled workers, and the like.

Further, since the number of road bridges and express skyways is increased and the length thereof is made longer, it is increasingly required to apply a waterproof treatment to the large area of them. Under the above circumstances, there is currently expected a novel waterproof layer construction method capable of constructing a long waterproof layer in a short period of time without requiring skilled workers.

Further, in the construction work for a large and long area including a bridge, a rooftop parking, a concrete road, and the like, since there is no means for comprehensively guaranteeing the secure execution of a waterproof layer in the entire area, it is guaranteed by the time-consuming management of respective constructors. Accordingly, there is a great expectation for a waterproof sheet in-situ application machine for easily and securely constructing a waterproof layer because a construction work period can be shortened and a time-consuming management can be omitted thereby.

SUMMARY OF THE INVENTION

An object of the present invention is to provide a waterproof sheet in-situ application machine capable of effectively, easily and securely laying a concrete surface with a waterproof sheet in a short period of time while suppressing the occurrence of problems of blistering, wrinkles, and the like.

Conventional problems, which the present invention intends to solve, are as described below.

(1) Conventionally, since a roll of a waterproof sheet having a length of about 10 to 15 m is laid while being carried by manpower, the sufficient number of workers is required to handle the waterproof sheet, and a long execution time is necessary to lay the waterproof sheet on a large area.

(2) When the conventional 10 to 15 m long sheets are laid, an overlapping portion is formed every 10 to 15 m. Since sheets each having a width of 1 m are bonded in parallel with each other, adjacent sheets overlap one another three times or in some cases four times every 10 to 15 m. When the thickness of the sheet is 2.5 mm, a stepped portion of 10 mm is formed in the four-layered overlapping portion thereof, thereby blistering (asphalt pavement is lifted up due thermally expanded air) is caused.

(3) The conventional construction method requires skilled workers.

(4) In the conventional construction method, asphalt is put into a large iron pot and heated and molten using a burner and the like, and a sheet is bonded using the molten asphalt. Since flammables must be carefully handled, a considerable amount of a $CO_2$ gas is generated, and offensive odors are generated, it cannot be said that the conventional construction method is an environment-friendly method.

The present invention can overcome all of these problems.

The inventors have developed the present invention by repeating tests for a main object of executing a waterproof work securely and reliably at a high speed to a large and long area such as the bed of a bridge, a concrete pavement constructed in a rooftop parking, and on the lower surface of a pavement having a drainage property. In the development of the invention, the inventors also focused on a problem of carbon dioxide in a construction site which is viewed with suspicion recently. As a result, the inventors have developed a waterproofing construction method which does not use a large amount of fuel such as propane gas in a site. This method is very near to a cold construction method and more reliable than a hot asphalt waterproofing method which has been most reliable up to now.

A waterproof sheet in-situ application machine of the present Invention for rewinding a rolled hot-melt adhesive type waterproof sheet and applying it onto the execution surface of the bed of a bridge and onto the execution surfaces of a concrete structure and the like includes a carriage, a waterproof sheet stand mounted on the carriage to suspend the rolled waterproof sheet, and a combination of any one or two or more of a sheet heater, a wrinkle prevention drum, a sheet roller pressing steel wheel roller and a sheet roller pressing rubber tire mounted on the carriage, wherein the sheet heater includes one or a plurality of heat resistant rollers each having a heating means such as a far infrared ray heater, and the waterproof sheet is applied onto the executed surface after the application surface of the waterproof of sheet is heated by being caused to be in contact with the heat resistant rollers, or the sheet heater includes a radiation heat generator such as a far infrared ray heater and an electric heater or a warm-air blasting device such as a warm-air blower for heating the waterproof sheet without being in contact therewith, and the water sheet is bonded onto the executed surface after being heated by the heater.

Further, the waterproof sheet application machine may be provided with a sheet overlapping portion heater as necessary.

The present invention provides an environment-friendly construction method capable of solving problems in safety and working environment with the reduction of the amount of $CO_2$ in place of the conventional construction method which is not suitable in safety and in which asphalt is molten at a high temperature and flowingly coated on a concrete surface, and an asphalt sheet is bonded thereon using the molten asphalt as a application agent in a working environment adversely affected by offensive odors and the like. Further, the present invention can guarantee the application property of the waterproof sheet in an important process of waterproofing because it is bonded by the waterproof sheet in-situ application machine under the same conditions at all times. As a result, mistakes and faulty portions in execution, which often occur conventionally, can be completely eliminated.

DESCRIPTION OF THE PREFERRED EMBODIMENTS

Figure 1:
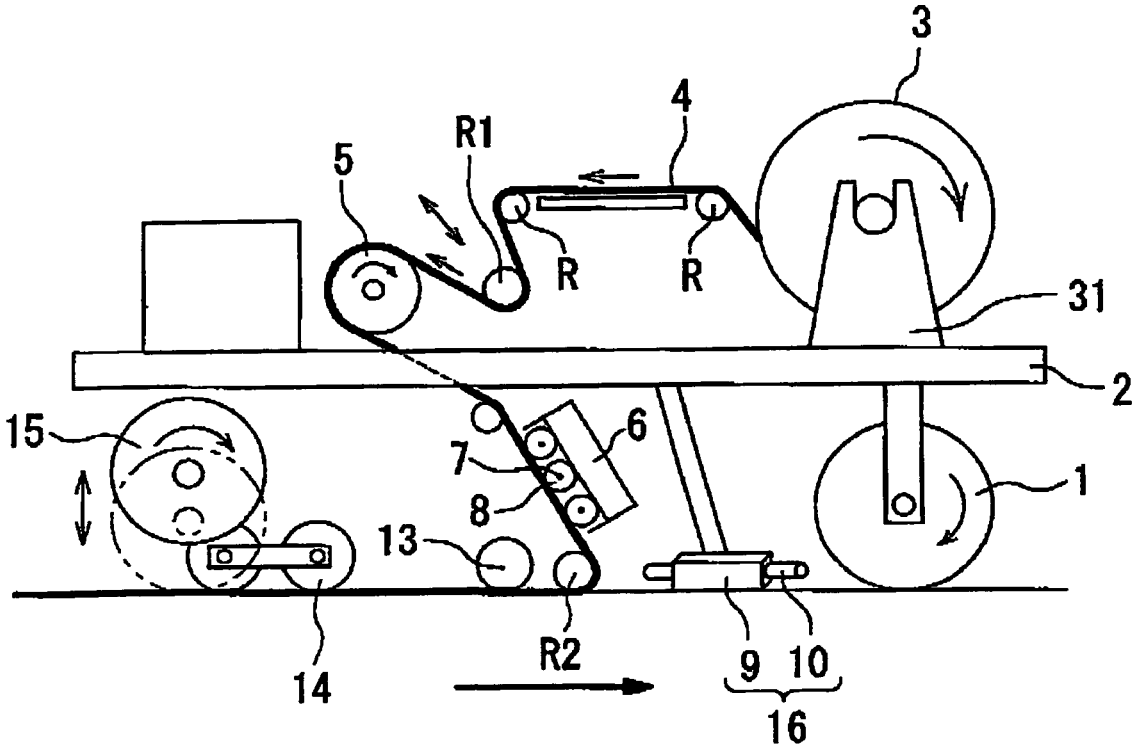
FIG. 1 is one example of configuration view of a waterproof sheet in-situ application machine of the present invention.

A waterproof sheet used in the present invention is not particularly limited, and any sheet may be used as long as it has a waterproof property and a thermal application property, and there is exemplified a so-called hot-melt adhesive type waterproof sheet which is ordinarily known as a waterproof sheet used in a torch construction method. There is, for example, a hot-melt adhesive type waterproof sheet which is composed of a core material such as a thick paper sheet, woven fabric, etc. and rubber asphalt, or synthetic resin. In addition to the above waterproof sheet, waterproof sheets devised by the inventors can be used. One of such waterproof sheets is composed of a thermoplastic material having a water permeable covering material laminated on one side thereof, and the other of the waterproof sheets is a type in which a covering material has a thermal bonding property. When the former waterproof sheet is heated, the thermoplastic material appears to the surface of the waterproof sheet through the covering material, and when the latter waterproof sheet is heated, the covering material itself is molten and bonded.

Since an ordinary waterproof sheet is rewound, that is, extended from a rolled state by a worker and laid in a construction site, the length and weight of the rolled sheet is restricted to 10 to 25 m and a weight which can be carried by manpower from a view point of handling. Then, although the extended sheet laid in the site, when the waterproof sheet in-situ application machine of the present invention is used, the length of the sheet can be increased within a range in which it can be suspended by a crane and the like. Even in a bridge in which a waterproof sheet had to be laid on an execution area having a long length, the inventors could reduce the number of overlapping portions using a waterproof sheet having a length of 100 m or more, normally, 200 to 400 m.

Although a carriage used in the present invention is preferably a self-propelled carriage, it is not limited thereto and may be a carriage which can be moved by being towed by other vehicle such as a car, a tractor and the like.

A wrinkle prevention drum, which is mounted on the carriage, is a steel drum having an appropriate diameter, and it is preferable that the steel drum have a smooth surface because it is in contact with the waterproof sheet. The drum is preferably rotated in a direction opposite to the traveling direction (feed direction) of the waterproof sheet likewise an ordinary reverse roll. Since the drum prevents the waterproof sheet from being wrinkled, it may be formed in a crown shape (drum shape) as necessary.

One type of a sheet heater is composed a steel, heat-resistant glass or ceramic heat resistant pipe or roller having a far infrared ray heater and the like disposed therein. Since the sheet heater is used in contact with the waterproof sheet, the heat resistant roller may be or may not be rotated in contact with the waterproof sheet. The sheet heater is preferably composed of metal such as stainless steel from the view point of cost and machining. The heat resistant roller nay be a type having the far infrared ray heater or an electric heater disposed therein as a heating means, or may be a type in which a heating medium is circulated in the roller. In addition to the above types, an electrically heated jacket roller may be used. Further, hot air may be blown to the heat resistant roller, or the roller may be heated from the outside thereof by a far infrared ray heater and the like. The necessary number of the heat resistant rollers is preferably disposed in a case whose side in contact with the waterproof sheet is opened.

As the other type of the sheet heater, a radiant heat generator such as a far infrared ray heater, an electric heater, and the like or a warm-air blasting device such as a hot air blower and the like are used to heat the waterproof sheet in a non-contact manner. Moreover, a heater such as a plurality of far infrared ray heaters disposed centrically the axis of a big metal pipe of a heater resistant roller may be provided.

A sheet overlapping portion heater heats a portion (overlapping portion) in which an end of a previously laid waterproof sheet overlaps an end of a waterproof sheet laid afterward and achieves a role similar to that of a home use iron. Thus, it is preferable that the heater have a flat bottom surface and heat the waterproof sheet under a certain degree of pressure. The heater is preferably composed of a square columnar metal body whose bottom surface acts as a contact surface with the waterproof sheet and which includes a heating means such as a far infrared ray heater, an electric heater, a heating medium and the like. The overlapping portion is heated by pressing the waterproof sheet-contact surface of the square columnar metal body against the overlapping portion, and then applying a next waterproof sheet to the heated overlapping portion.

A sheet roller pressing steel wheel roller can bond a waterproof sheet laid on an execution surface thereon under appropriate pressure as well as is used to eliminate the swelling and the like of the waterproof sheet caused by the air remaining between the execution surface and the waterproof sheet and by the heat generated therebetween. In order to roll-press the waterproof sheet laid on the execution surface, the sheet roller pressing steel wheel roller is composed of a multiplicity of steel wheels each having an appropriate width of, for example, 5 cm, disposed in conformity with the width thereof in the width direction of the sheet, and having a shaft whose diameter is slightly smaller than the central shaft holes of the steel wheels and which passes therethrough so that the steel wheels are arranged as a single roller. The roller composed of the multiplicity of steel wheels is arranged such that when it rolls on the waterproof sheet, the respective steel wheels move up and down according to the irregular surface of the waterproof sheet. The material of the steel wheels each having the appropriate width and forming a unit component is not limited to steel, and any appropriate material may be used as log as it is suitable for the object of the present invention.

A sheet roller pressing rubber tire finally causes the waterproof sheet to come into contact with the execution surface under pressure, and may be composed of ordinary tires appropriately disposed in conformity with the width of the waterproof sheet or may be composed of a single large rubber tire. The tire may also have a role for driving the carriage.

The present invention will be explained below in detail with reference to an example.

EXAMPLE

The waterproof sheet in-situ application machine of the present invention is arranged as shown in FIG. 1.

1. Self-Propelling Carriage

A self-propelled carriage 2 is provided with hydraulic, electric or engine driven wheels 1 and can travel forward and rearward as well as can change the traveling direction thereof.

2. Waterproof Sheet Stand

A roll 3 of a waterproof sheet 4 having a length of 300 to 400 m can be placed on a waterproof sheet stand 31.

3. Wrinkle Prevention Drum

A wrinkle prevention drum 5 rotating in a direction opposite to the moving direction of the waterproof sheet 4 is provided to bond the waterproof sheet 4 onto an execution surface without the occurrence of wrinkles and rotated in contact with the waterproof sheet 4 to thereby prevent the sheet from loosening and meandering so that the occurrence of wrinkles can be prevented when the sheet is bonded.

4. Sheet Heater

Figure 2A:
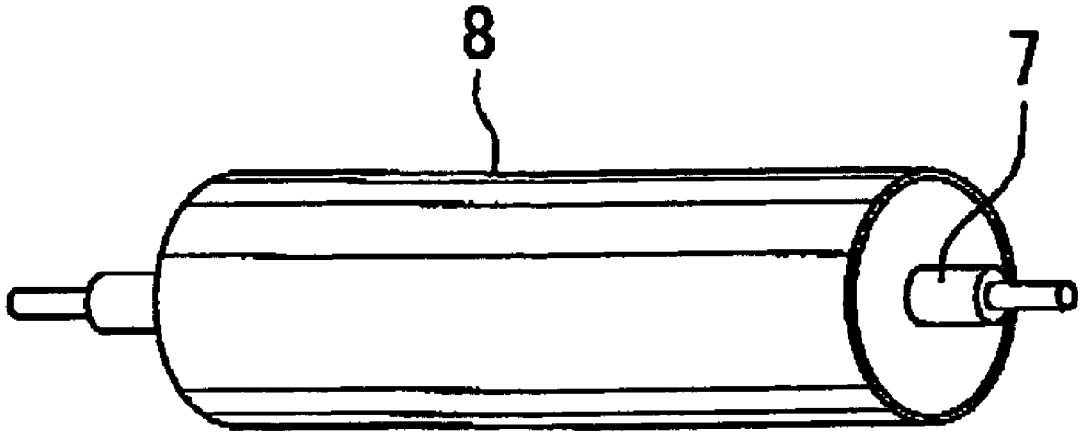
FIG. 2A and FIG. 2B are a perspective view explaining the structure of a sheet heater.
Figure 2B:
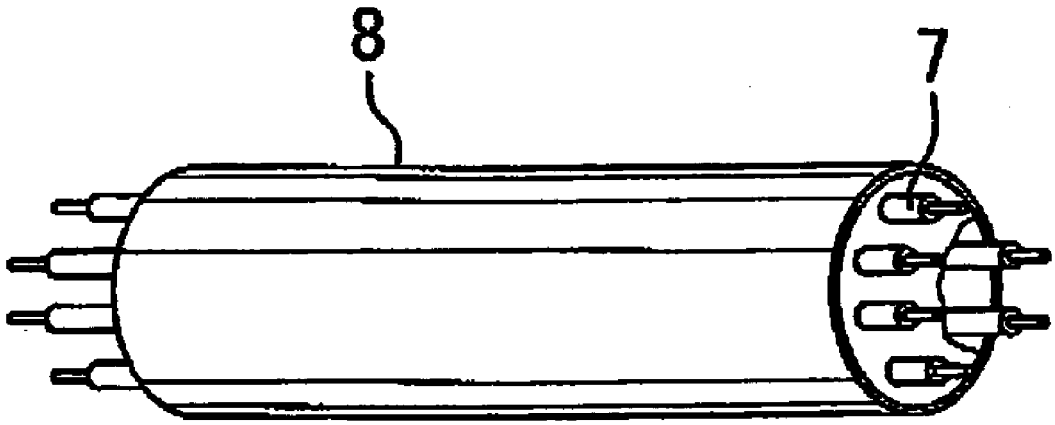

A sheet heater 6 is composed of a far infrared ray heater 7 inserted into a metal pipe 8. (see FIG. 2A). A plurality of the far infrared ray heater 7 may be placed one by one in the metal pipe 8, and the plurality of the far infrared ray heater 7 may be placed in one metal pipe 8 in equal intervals. (see FIG. 2B) The metal pipe 8 is heated by energizing the far infrared ray heater 7, and rubber asphalt and synthetic resin on the surface of the waterproof sheet 4 is molten by causing the surface of the waterproof sheet to be in contact with the surface of the heated metal pipe 8, thereby the waterproof sheet 4 can be bonded onto an execution surface.

Examples of the sheet heater 6 are shown. Ordinarily, the far infrared ray heater has a diameter of about 18 to 22 mm, and the metal pipe 8 is composed of an SGP pipe and the like having an outside diameter of 48 mm and a pipe thickness of 3.5 mm. Note that the metal pipe 8 is preferably journaled by heat resistant bearings for rotation.

5. Sheet Overlapping Portion Heater

The waterproof sheet 4 is bonded with an overlapping portion having a width of about 10 cm. Although a new waterproof sheet 4 is bonded in parallel with a waterproof sheet 4 bonded already, the bonding force of the already applied waterproof sheet 4 can be enhanced by heating the overlapping portion thereof.

Figure 3:
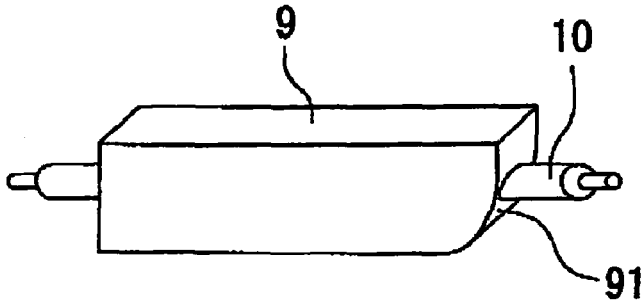
FIG. 3 is a perspective view explaining the arrangement of a sheet overlapping portion heater.
Figure 4:
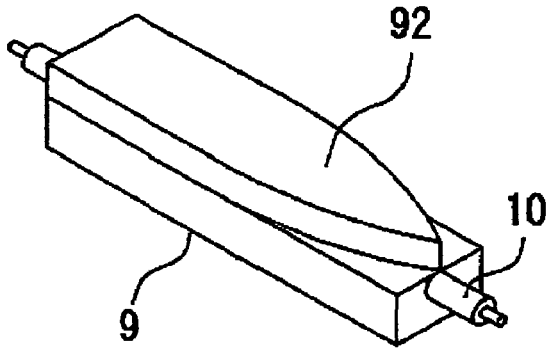
FIG. 4 is a perspective view showing the shape of the bottom of the sheet overlapping portion heater.

As shown in, for example, FIG. 3, a sheet overlapping portion heater 16 is composed of a far infrared ray heater 10 disposed in a metal square column (or square pipe) 9, and the overlapping portion of a previously laid waterproof sheet 4 is pressed against the bottom surface 9*a* of the metal square column 9 so as to be pressed. An edge of a next waterproof sheet 4 is bonded to the thus heated overlapping portion. The bottom surface of the square pipe 9 is formed in a ship shape 92 with its extreme end in a traveling direction having an acute angle likewise a home use iron (refer to FIG. 4) or may be formed in a curved surface 91 so that the waterproof sheet 4 can be easily placed thereon (refer to FIG. 3).

6. Sheet Roller Pressing Steel Wheel Roller

Figure 5:
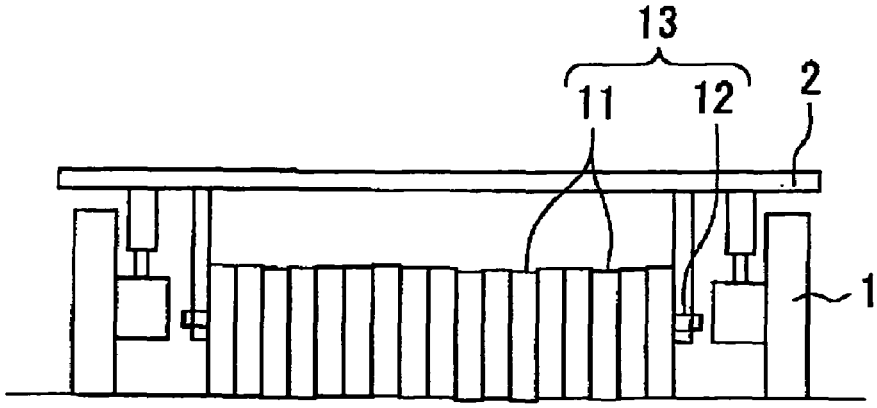
FIG. 5 is a front elevational view of a sheet roller pressing steel wheel roller.

In order to compact the waterproof sheets 4 being laid, a sheet roller pressing steel wheel roller 13 is composed of a multiplicity of steel wheels 11 each of which has a width of about 5 cm and an approximately flat contact surface and which are disposed in conformity with the width of the waterproof sheets 4. The roller 13 includes a shaft 12 having a diameter slightly smaller than the central shaft holes of the steel wheels 11 and passing therethrough so that the steel wheels 11 are arranged as a single roll. The roller 13 composed of the steel wheels 11 is arranged such that when it rolls on the waterproof sheet, the respective steel wheels 11 move up and down according to the irregular surface of the waterproof sheet. (See FIG. 5)

Figure 6A:
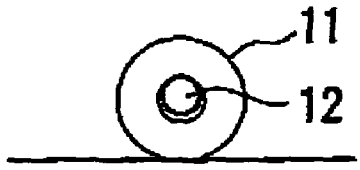
FIG. 6A and FIG. 6B are side elevational views showing the movement of the steel wheel roller.
Figure 6B:
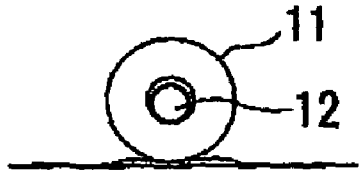

FIG. 6A and FIG. 6B show the relation between each of the steel wheels 11 as a unit component and the shaft 12. As shown in FIG. 6A, the waterproof sheet 4 is ordinarily pressed by the weight of the steel wheel 11, and as shown in FIG. 6B, the steel wheel 11 moves up and down according the irregular surface of the waterproof sheet 4. 7. Sheet roller pressing tire A sheet roller pressing tire 14 is composed of flat rubber tires alternately disposed so that they have a width larger than the width of the waterproof sheets 4 and bond the waterproof sheets 4 by further applying pressure to the waterproof sheets 4 having been compacted by the sheet roller pressing steel wheel roller 13.

As shown in FIG. 1, the waterproof sheet in-situ application machine arranged as described above rewinds the roll 3 of the hot-melt adhesive type waterproof sheet 4 placed on the stand 31, feeds the waterproof sheet 4 to the sheet heater 6 through the wrinkle prevention drum 5, and the waterproof sheet 4 heated by the sheet heater 6 with the application surface thereof made to a heated and molten state is supplied onto the execution surface. The waterproof sheet 4 laid on the execution surface is bonded to the execution surface under pressure by the sheet roller pressing steel wheel roller 13 and the sheet roller pressing rubber tires 14. In FIG. 1, R shows a feed roll, R1 shows a tension roll for preventing the waterproof sheet 4 from loosening during feeding, and R2 shows a contact roll for causing the waterproof sheet 4 to be in contact with the execution surface. Reference numeral 15 denotes drive tires which are lowered onto the ground when the waterproof sheet in-situ application machine is moved to other execution site.

When a waterproof sheet 4 having been bonded is disposed adjacent to a waterproof sheet 4 to be bonded in the width direction thereof, the sheet overlapping portion heater 16 is used to heat the portion of the previously bonded waterproof sheet 4 which overlaps the waterproof sheet 4 to be bonded this time. The overlapping portions of the sheets are finished flat by being heated, and further the waterproof property of the waterproof sheets 4 can be improved by being overlapped.

The following effects can be achieved by using the waterproof sheet in-situ application machine of the present invention:

1. Since the waterproof sheet of the present invention is rolled in a long length, it can be bonded onto a large area in a short time;

2. In the waterproof sheet in-situ application machine of the present invention, since the overlapping portions of the waterproof sheets are reduced and the waterproof sheets are compacted at the same time when they are bonded, the occurrence of blistering can be suppressed;

3. The waterproof sheet in-situ application machine of the present invention requires no skilled worker;

4. The waterproof sheet in-situ application machine is friendly to an environment because a gas burner and the like from which flame is generated is not used, the waterproof sheet can be bonded safely with a less amount of generation of $CO_2$, and no offensive odor is generated; and 5. When the waterproof sheet in-situ application machine is set once, it can execute a stable application job, thereby the definite quality of the bonded waterproof sheet can be obtained.

Figure 7:
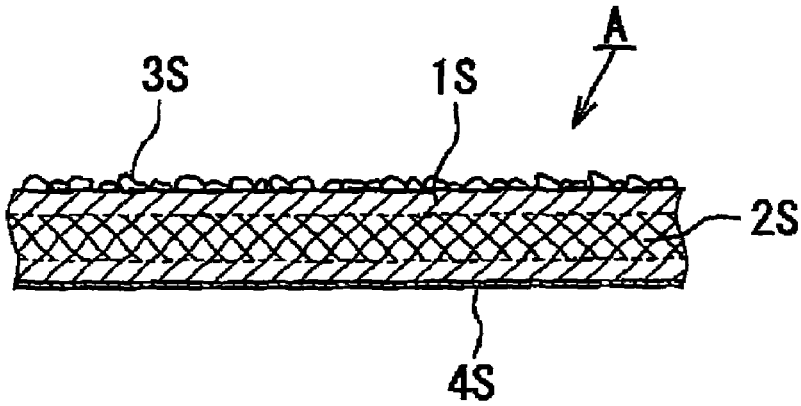
FIG. 7 is a schematic sectional view showing an example of a waterproof sheet.

FIG. 7 is a schematic sectional view showing an example of a waterproof sheet preferably used in the present invention.

In FIG. 7, 1S shows a base material composed of a hot-melt adhesive, 2S shows a reinforcing core material composed of woven fabric, non-woven fabric, and the like, 3S shows fine grains such as silica sand and the like, and 4S shows a covering material.

The waterproof sheet is made by, for example, the following method. A mixture of petroleum asphalt and SBS (styrene-butadiene-styrene copolymer) or SIS (styrene-isoprene-styrene copolymer) thermoplastic elastomer or APP (atactic polypropylene) is used as the thermally melting application material acting as the base material 1S and heated and molten, a base material sheet including the reinforcing core material 2S is made by coating the mixture in the heated and molten state on one side or both the sides of the reinforcing core material 2S, and the covering material 4S is applied to the lower surface of a resultant base material sheet when it is wound as well as the fine grains 3S such as the silica sand are deposited on the front surface of the base material sheet, thereby the base material sheet is wound as the waterproof sheet.

The thermally melting application material as the base material is molten by heat and solidified on the application surface thereof to thereby exhibit application force. Exemplified as the base material is, for example, the mixture of petroleum asphalt and SBS or SIS thermoplastic elastomer or APP. The base material is finished to a sheet shape by heating and melting the above material or by coating the heated and molten material to a core material. The core material is preferably composed of a porous material such as glass fiber fabric which can be easily impregnated with the molten material, in addition to paper, textile fabric, non-woven fabric, and the like. Further, it is preferable that the core material be accommodated at the central position of the material sheet obtained by being coated with the molten material. The base material is formed to a sheet having a thickness of about 1 to 5 mm and preferably about 1.5 to 4 mm. Although the melting temperature of the base material is not particularly limited, the base material preferably has such a thermal melting property that when it is heated at a temperature of 100° C. to 400° C. to bond the waterproof sheet, it appears to the surface of the covering material.

The permeable covering material is composed of a sheet-like material, for example, polyester non-woven fabric and the like having many intervals among fibers so that the base material, which is molten when the waterproof sheet is heated, can pass through them. Any material can be used as the permeable coveting material as long as it has a suitable permeability (air permeability), in addition to a material whose intervals can be visually observed, and porous paper, porous fabric and porous non-woven fabric, and the like can be exemplified.

The thermal application covering material, which is molten by predetermined heat applied thereto and exhibits a application property is a film composed of a mixture of SBS or SIS thermoplastic elastomer, PE (polyethylene), PP (polypropylene), APP, and the like, and the film may have an entirely flat permeable surface or may have many suitable small holes and cut lines formed on the surface. When the melting temperature of the film is set slightly higher than that of the base material, a material resulting from both the molten base material and the molten covering material is formed on the surface of the waterproof sheet when it is heated, thereby application force can be adjusted.

A mineral grain surface formed on the other surface of the base material is ordinarily composed of a sand layer containing silica sand, fine sand and the like. The size of grains is not particularly limited, it is preferably selected according to an asphalt pavement material applied to the upper surface of the waterproof sheet.

According to a first execution method of the waterproof sheet of the present invention, the waterproof sheet, which has the permeable covering material formed on the back surface thereof, is prepared such that an execution surface is covered with the surface of the covering material, and surface of the covering material is heated to thereby heat and melt the thermally melting application material as the base material of the waterproof sheet so that the covering material is bonded onto the execution surface in the state that the thermally melting application material appears on the surface of the covering material passing therethrough.

In the waterproof sheet of the present invention, since the thermally melting application material appearing on the surface of the covering material acts as an application agent, it is not necessary to use molten asphalt and the like as an application agent. More specifically, polyester non-woven fabric having a basis weight (area weight) of, for example, 10 g/m$^2$ to 30 g/m$^2$, and the like are exemplified as the permeable covering material. The covering material may be rough fabric such as gauze. Since the surface of the covering material of the waterproof sheet is heated in contact with the heat resistant roller of the sheet heater, the thermally melting application material is prevented from depositing on the heat resistant roller, and the waterproof sheet is prevented from being molten and cut off by heat.

According to a second execution method of the present invention in which the waterproof sheet is heated without being in contact with the heat resistant roller and the like, the waterproof sheet may be bonded to the execution surface through the covering material composed of a material having a thermally application property by itself. Otherwise, the covering material is formed of a net-like sheet composed of a thermal application material having a melting temperature slightly higher than that of the thermally melting application material of the base material, and the waterproof sheet is bonded to the execution surface by the molten base material, which oozes out the meshes of the covering material when the waterproof sheet is heated, and the molted covering material.

What is claimed is:

1. A waterproof sheet application machine for unwinding a rolled hot-melt adhesive type waterproof sheet and applying it onto a construction surface, the waterproof sheet application machine comprising:

a carriage;

a waterproof sheet stand mounted on the carriage to suspend the rolled waterproof sheet; and a combination of a sheet heater and any one or more of: a wrinkle prevention drum, a steel wheel sheet roller, and a rubber tire sheet roller mounted on the carriage, wherein the sheet heater comprises one or a plurality of heat transmissive rollers each having a heating means, and the waterproof sheet is bonded onto the execution surface after the application surface of the waterproof sheet is heated by being caused to be in contact with the heat transmissive rollers.

2. A waterproof sheet application machine according to claim 1, wherein the waterproof sheet unwound from the waterproof sheet stand is bonded onto the construction surface after it sequentially passes through the wrinkle prevention drum, the sheet heater, the steel wheel sheet roller, and the rubber tire sheet roller.

3. A waterproof sheet application machine according to claim 1, wherein the steel wheel sheet roller comprises a multiplicity of steel wheels each having an appropriate width of, for example, about 5 cm, disposed in conformity with the width of the waterproof sheet, and having a shaft whose diameter is slightly smaller than the central shaft holes of the steel wheels and passing therethrough so that the steel wheels are arranged as a single roller and can move up and down according to the irregularity of the construction surface.

4. A waterproof sheet application machine according to claim 1, wherein the waterproof sheet comprises a waterproof sheet having a total length of 100 m or more.

5. A waterproof sheet application machine according to claim 1, wherein the heat transmissive roller of the sheet heater comprises a roller having one of a far infrared ray heater and an electric heater disposed therein.

6. A waterproof sheet application machine according to claim 1, wherein the heating means of the heat transmissive roller of the sheet heater executes heating by circulating a heating medium in the roller.

7. A waterproof sheet application machine according to claim 1, wherein the heat transmissive roller of the sheet heater comprises an electric heating type jacket roller.

8. A waterproof sheet application machine for unwinding a rolled hot-melt adhesive type waterproof sheet and application it onto a construction surface, the waterproof sheet application machine comprising:

a carriage;

a waterproof sheet stand mounted on the carriage to suspend the rolled waterproof sheet; and a combination of a sheet heater and any one or more of: a wrinkle prevention drum, a steel wheel sheet roller, and a rubber tire sheet roller mounted on the carriage, wherein the sheet heater comprises a radiation heat generator comprising one of a far infrared ray heater and an electric heater for heating the waterproof sheet without being in contact therewith.

9. A waterproof sheet application machine according to claim 8, wherein the sheet heater comprises a warm-air blower for heating the waterproof sheet in a non-contact manner.

10. A waterproof sheet application machine according to claim 1, further comprising a sheet overlapping portion heater comprising a columnar metal body having a bottom surface acting as a waterproof sheet contact surface and comprising heating means of any one of a far infrared ray heater, an electric heater and a heating medium, wherein the overlapping portion of a waterproof sheet is heated by being pressed against the waterproof sheet contact surface of the columnar metal body, and a next waterproof sheet is bonded onto the overlapping portion of the waterproof sheet.

11. A waterproof sheet application machine according to claim 8, further comprising a sheet overlapping portion heater comprising a columnar metal body having a bottom surface acting as a waterproof sheet contact surface and comprising heating means of any one of a far infrared ray heater, an electric heater and a heating medium, wherein the overlapping portion of a waterproof sheet is heated by being pressed against the waterproof sheet contact surface of the columnar metal body, and a next waterproof sheet is bonded onto the overlapping portion of the waterproof sheet.

12. A waterproof sheet application machine according to claim 1, wherein the waterproof sheet comprises a waterproof sheet having a total length of 200 to 400 m.

13. A waterproof sheet application machine for unwinding a rolled hot-melt adhesive type waterproof sheet and applying it onto a construction surface, the waterproof sheet application machine comprising:

a carriage;

a waterproof sheet stand mounted on the carriage to suspend the rolled waterproof sheet; and a combination of any two or more of: a wrinkle prevention drum, a sheet heater, a steel wheel sheet roller, and a rubber tire sheet roller mounted on the carriage, wherein the wrinkle prevention drum rotates.

14. A waterproof sheet application machine according to claim 13, wherein the combination comprises at least the wrinkle prevention drum, and the wrinkle prevention drum rotates in a direction opposite to the unwinding of the waterproof sheet unwound from the waterproof sheet stand.

15. A waterproof sheet application machine according to claim 13, wherein the combination comprises at least the wrinkle prevention drum, and the waterproof sheets bends about 180 degrees around the wrinkle prevention drum.

16. A waterproof sheet application machine according to claim 13, wherein the combination comprises at least the wrinkle prevention drum, and the wrinkle prevention drum rotates in a direction opposite to the unwinding of the waterproof sheet unwound from the waterproof sheet stand and the waterproof sheets bends about 180 degrees around the wrinkle prevention drum.

17. A waterproof sheet application machine according to claim 13, wherein the combination comprises any three or more of the wrinkle prevention drum, the sheet heater, the steel wheel sheet roller, and the rubber tire sheet roller mounted on the carriage.

18. A waterproof sheet application machine according to claim 13, wherein the combination comprises the wrinkle prevention drum, the sheet heater, the steel wheel sheet roller, and the rubber tire sheet roller mounted on the carriage.

* * * * *